United States Patent [19]

Holtkamp et al.

[11] Patent Number: 5,025,242

[45] Date of Patent: Jun. 18, 1991

[54] OVEN THERMOSTAT

[75] Inventors: Calvin J. Holtkamp; George L. Hetrick; Richard Warren, all of Mansfield, Ohio

[73] Assignee: Robertshaw Controls Company, Inc., Richmond, Va.

[21] Appl. No.: 558,324

[22] Filed: Jul. 24, 1990

[51] Int. Cl.[5] ..... H01H 37/36; H01H 37/12

[52] U.S. Cl. ..... 337/309; 337/323

[58] Field of Search ..... 337/309, 310, 311, 319, 337/320, 323

[56] References Cited

U.S. PATENT DOCUMENTS

| | | | |
|---|---|---|---|
| 3,348,009 | 9/1965 | Staples . | |
| 3,752,954 | 8/1973 | Holtkamp . | |
| 3,821,681 | 6/1974 | Staples | 337/319 |
| 3,891,957 | 6/1975 | Holtkamp . | |
| 4,166,268 | 8/1979 | Beck | 337/309 |
| 4,214,224 | 7/1980 | Holtkamp | 337/323 |

*Primary Examiner*—Harold Broome

*Attorney, Agent, or Firm*—Pearne, Gordon, McCoy & Granger

[57] ABSTRACT

An oven control for self-cleaning ovens provides a hydraulic sensing system having a wafer-like bellows. The position of the bellows is adjusted by a face cam on a control shaft in the BAKE and BROIL modes of operation. The bellows also controls the temperature of the oven for SELF-CLEANING. However, the face cam does not determine the SELF-CLEANING temperature. A door lock operator switch is also operated by the bellows, but is connected so that the adjusted position of the bellows does not affect the door lock operating temperature. Three separate calibration adjustments are provided. The first calibrates the operating temperature in the BAKE and BROIL modes of operation. The second calibrates the SELF-CLEANING temperature, and the third calibrates the door lock operating temperature. A bimetal ambient temperature compensator is provided to compensate for variations in the ambient temperature of the control.

29 Claims, 8 Drawing Sheets

OVEN THERMOSTAT

BACKGROUND OF THE INVENTION

This invention relates generally to oven controls, and more particularly to a novel and improved thermostatic control for self-cleaning ovens and the like.

PRIOR ART

Thermostatic controls for self-cleaning ovens generally perform several functions. For example, they provide automatic temperature regulation for baking. The range of baking temperatures tends to extend to about 500° F. The controls also usually provide for temperature control for broiling. Further, the controls regulate the cleaning temperature when the oven is a self-cleaning oven, and control a door lock operation during the oven cleaning operation. In most cases, the oven control is used in conjunction with a selector switch that permits the user to select the desired mode of operation. Examples of a variety of such thermostatic oven controls are illustrated in U.S. Pat. Nos. 3,348,009; 3,752,954; 3,821,681; 3,891,957; 4,166,268; and 4,214,224.

In some such thermostats, the adjustment of the control has been provided by a shaft which is threaded into the control housing, and therefore only provides a relatively small angular movement for the entire range of baking temperatures. In other instances, the door lock cannot be released after a cleaning cycle has been completed and the oven has cooled unless the control is set at elevated temperature positions.

Because such thermostat controls must perform a number of separate functions, the mechanism has been relatively complicated and bulky.

SUMMARY OF THE INVENTION

There are a number of important aspects to this invention. It is one important aspect to provide a novel and improved, easily produced, compact oven control operable to perform all of the various functions required in the thermostatic control of a self-cleaning oven. Such control provides a number of separate and distinct control operations. A first control operation permits the selection of the desired bake temperature. The bake temperature settings are provided utilizing a cam structured so that the control knob rotation in a bake temperature range extends through a substantial portion of a full turn. This has the effect of expanding the bake temperature scale and maximizing the degrees of rotation of the control knob for a given amount of temperature change.

A second control operation involves the regulation of the oven temperature during the BROIL mode of operation. A third control operation involves the actuation and release of the oven door lock at a predetermined oven temperature. The release of the door lock is accomplished whenever the oven temperature is below the oven door lock operating temperature regardless of the control setting.

A fourth control operation involves the automatic regulation of the cleaning temperature during the cleaning cycle of the oven.

There are three separate and distinct calibration mechanisms provided. A first calibration mechanism independently calibrates the operating temperatures throughout the bake range of temperatures and the broil temperature. A separate and independent second calibration mechanism is provided to establish the door lock actuating operation temperature. A third and distinct calibration mechanism provides the calibration of the oven temperature during the cleaning cycle.

As an additional function, a switch is provided to prevent operation of the oven in the CLEAN mode unless the separate selector switch and the thermostat control are both set in the cleaning position. Similarly, the switch prevents the operation of the oven in a bake or broil mode if the separate selector switch is not set in the associated one or the other of such positions.

The illustrated embodiment of a thermostat control provides a control shaft journaled in the control body for rotation about its longitudinal axis. Mounted on the control shaft is a cam providing a face cam portion for temperature regulation and a lateral cam portion for the operation of a selector switch provided by the control.

The temperature sensor is a hydraulic sensor having a remote probe connected by a capillary tube to a wafer-like bellows mounted within the control body. The face cam operates to adjust the position of one side of the wafer bellows relative to the body for adjusting the operating temperature of the control during bake and broil operations. The opposite side of the wafer bellows actuates a Valverde-type spring which produces snap action of a double-pole, single-throw switch. Such switch controls the operation of the heater element and thereby controls the temperature in the oven.

The face cam provides a recessed zone which is moved into alignment with the adjacent portion of the wafer to disengage the wafer from the face cam during cleaning operations. The temperature during the cleaning cycle is controlled by the wafer bellows moving into engagement with a calibrated support surface. In the cleaning mode, the double-pole, single-throw snap acting switch again operates to control the heating elements.

A separate door lock switch is provided and is connected to the bellows so that adjustment of the bellows position within the body does not affect the operating temperature of the door lock. Therefore, the door lock operating temperature is independent of the adjusted position of the bellows. This is accomplished by providing an S spring and a coupler between the remote side of the bellows and the S spring.

A bimetal support for the adjusting shaft of the control is provided for ambient temperature compensation. Openings in the bimetal support cooperate with a detent spring to provide detents at several shaft positions.

These and other aspects of this invention are illustrated in the accompanying drawings, and are more fully described in the following specification.

DETAILED DESCRIPTION OF THE DRAWINGS

Figure 1:
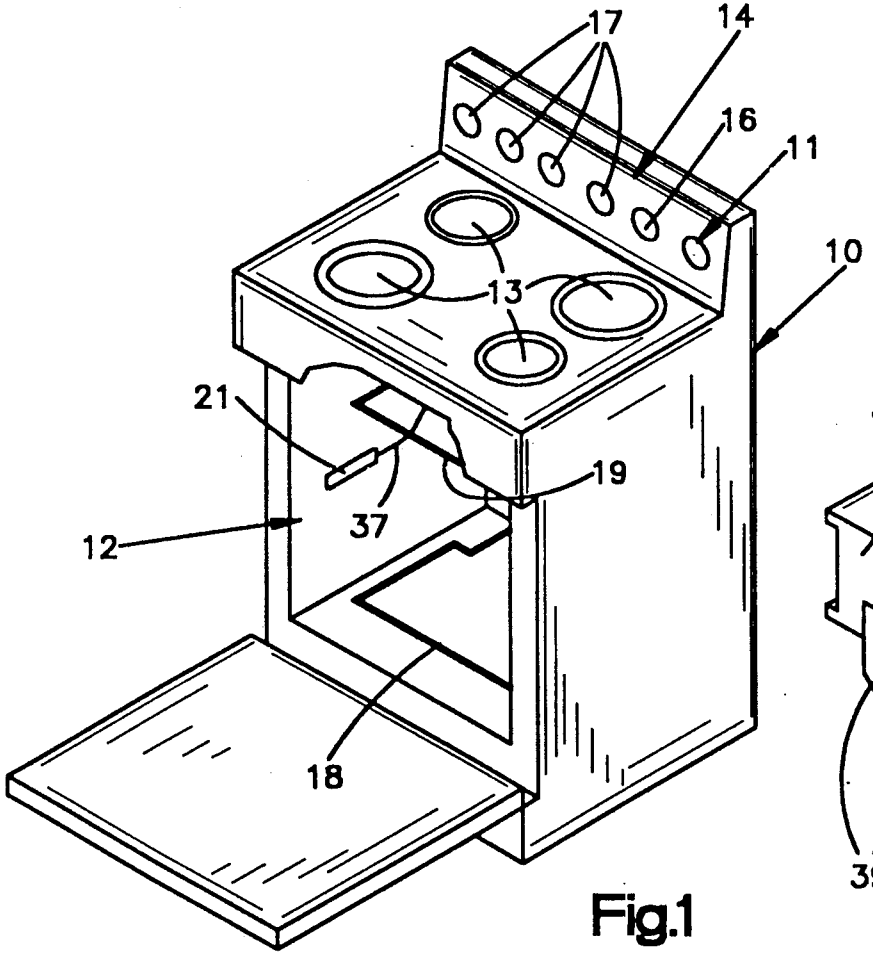
FIG. 1 is a schematic, perspective view of a typical electric range with a thermostatic oven control in accordance with the present invention mounted thereon.

FIG. 1 schematically illustrates a typical cooking range 10 having a thermostatic oven control 11 installed thereon. Such range provides an oven 12 and a plurality of surface cooking units 13. The illustrated range 10 provides a control panel 14 in which the oven control 11 is mounted along with a selector switch 16 and a surface unit control 17 associated with each of the surface units 13.

Typically, the oven 12 is provided with a lower bake heating element 18 and an upper broil heating unit 19. The upper and lower heaters 18 and 19 are controlled by the thermostat control 11 in combination with the setting of the selector switch 16 in manners known to those skilled in the art. The thermostat control 11 is provided with a bulb 21 containing a liquid which expands and contracts in response to changes in oven temperature and operates as the sensor for the thermostat control 11.

Figure 2:
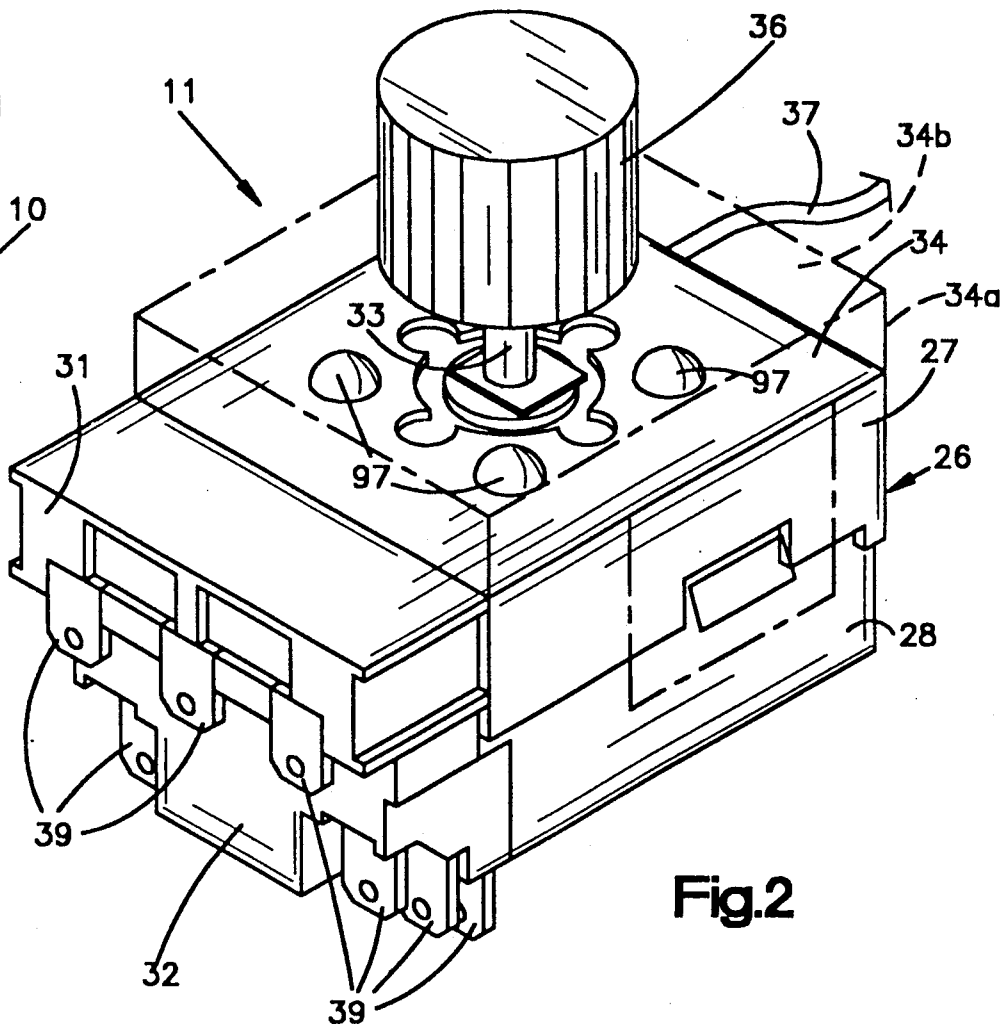
FIG. 2 is a schematic, perspective view of the thermostatic oven control per se.

FIG. 2 schematically illustrates a control 11 per se. Such control includes a body assembly 26 consisting of an upper sheet metal body portion 27 and a lower sheet metal body portion 28 which cooperate to define a cavity in which functioning portions of the control are located. The body assembly also includes three molded plastic switch cases 31, 32, and 32*a* in which the control switches per se are located. The operating temperatures regulated by the control 11 are adjusted by a control shaft 33 which extends from the interior of the control through an upper face 34. A mounting bracket 34*a*, illustrated in FIG. 2 in phantom in order to better illustrate the functioning portion of the control, provides a mounting surface 34*b* for the control. Typically, a control knob 36 is mounted on the shaft 33, permitting user rotation of the shaft 33 about its longitudinal axis. The control 11 also provides a capillary tube 37 which extends from a wafer or bellows 38 (illustrated in FIG. 3) within the body assembly 26 and the bulb 21. Typically, the bulb 21, capillary tube 37, and bellows 38 are filled with a liquid such as NAK, which can function in the high temperature environment of a self-cleaning oven. Such liquid expands when the temperature sensed by the bulb 21 increases and contracts when such temperature decreases.

The switch connections for the control are provided by nine terminals 39, permitting the switch to be connected to the control circuit of the range. The terminals 39 all extend parallel to each other in a direction back from the mounting surface 34*b* so that the switch can be easily connected to the control circuit in substantially any mounted position. Further, by providing parallel connectors, the control can be connected to the circuit by means of a single mating connector receptacle. By arranging the terminals in this manner, the labor of installation of the control is minimized and the likelihood of improper connections is virtually eliminated.

Figure 3:
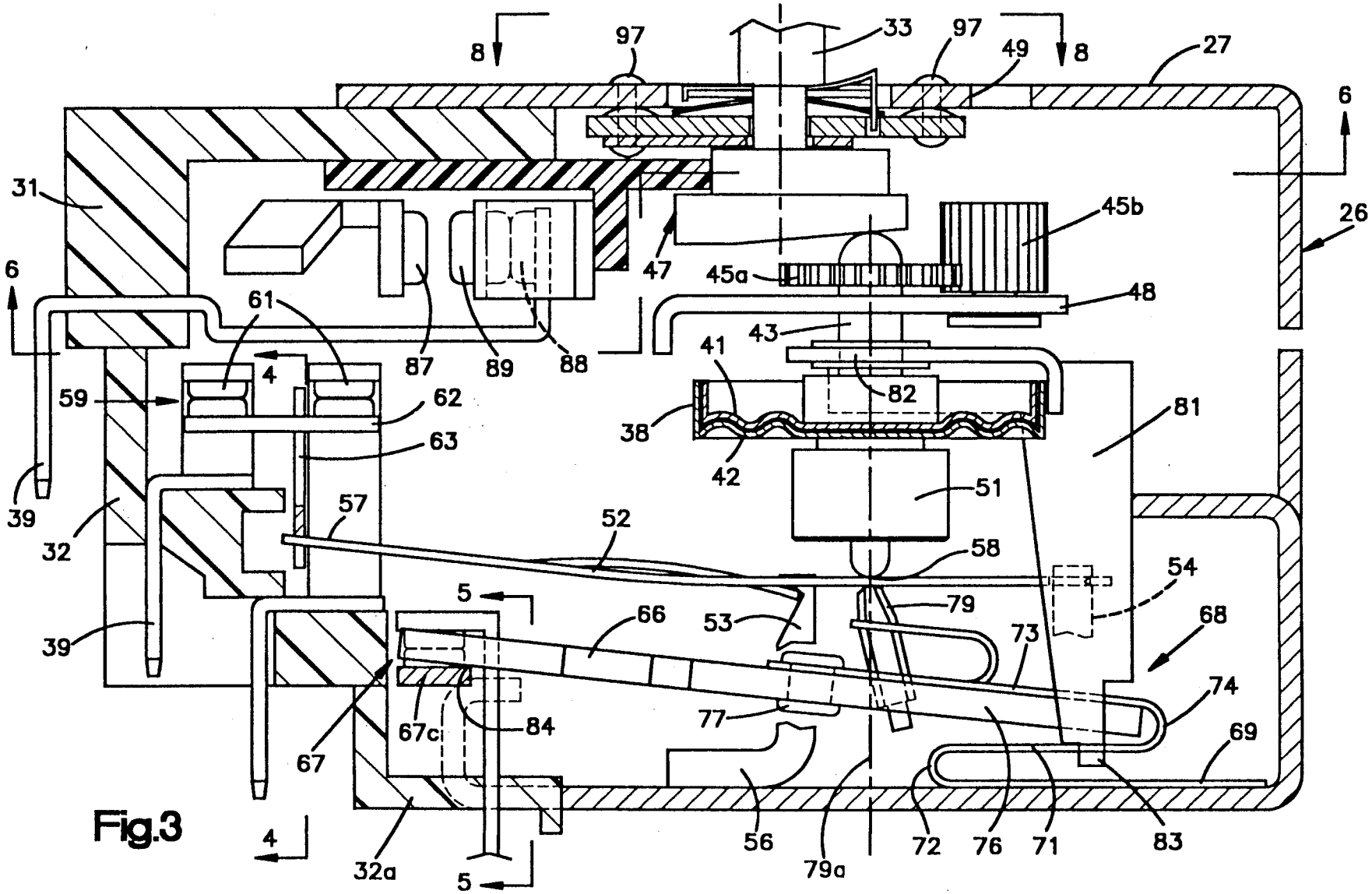
FIG. 3 is a cross section of the control, illustrating the functional components of the interior of the control.
Figure 7:
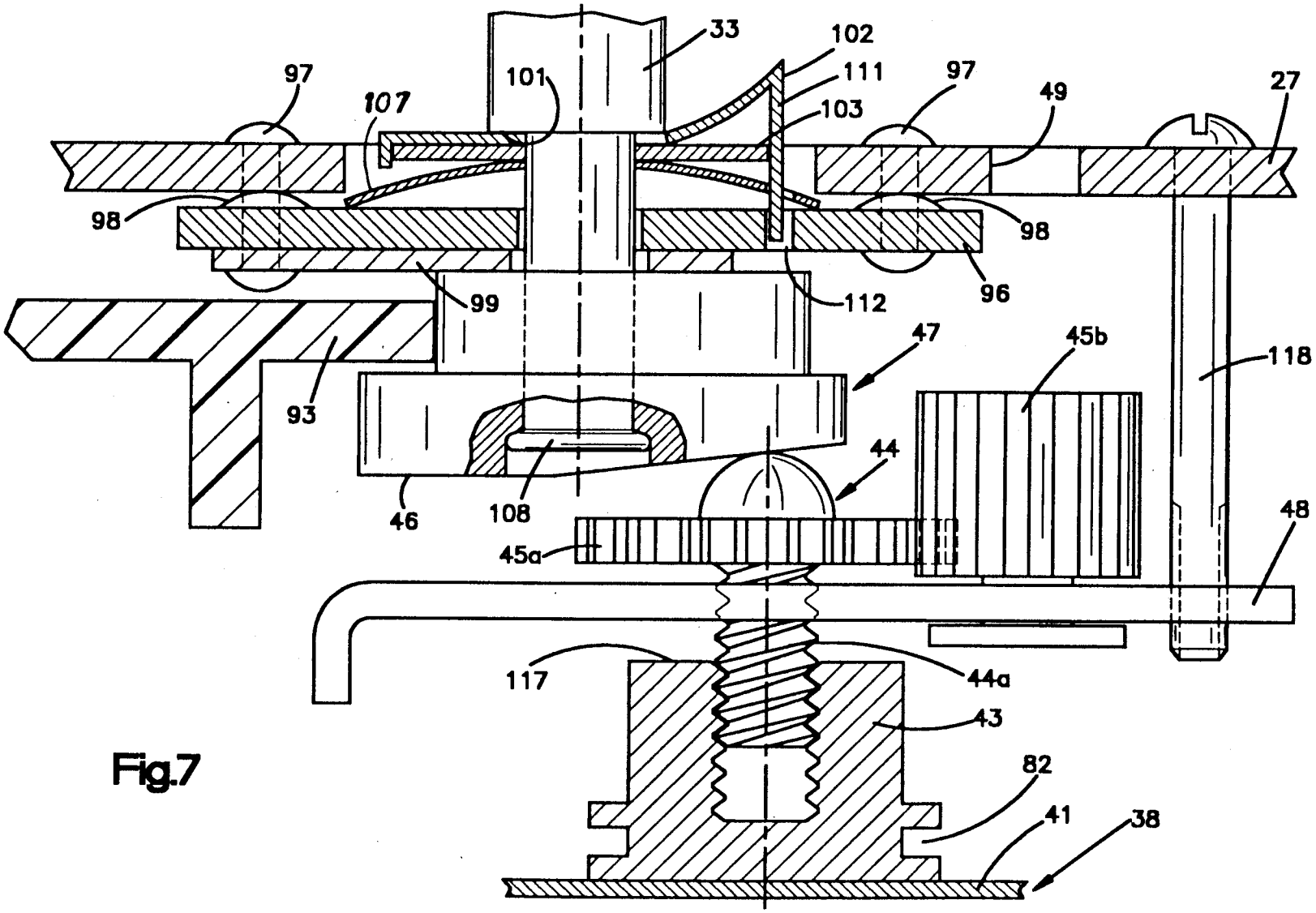
FIG. 7 is an enlarged fragmentary section illustrating the structural detail of the mounting of the cam and adjacent portions of the bellows.
Figure 8:
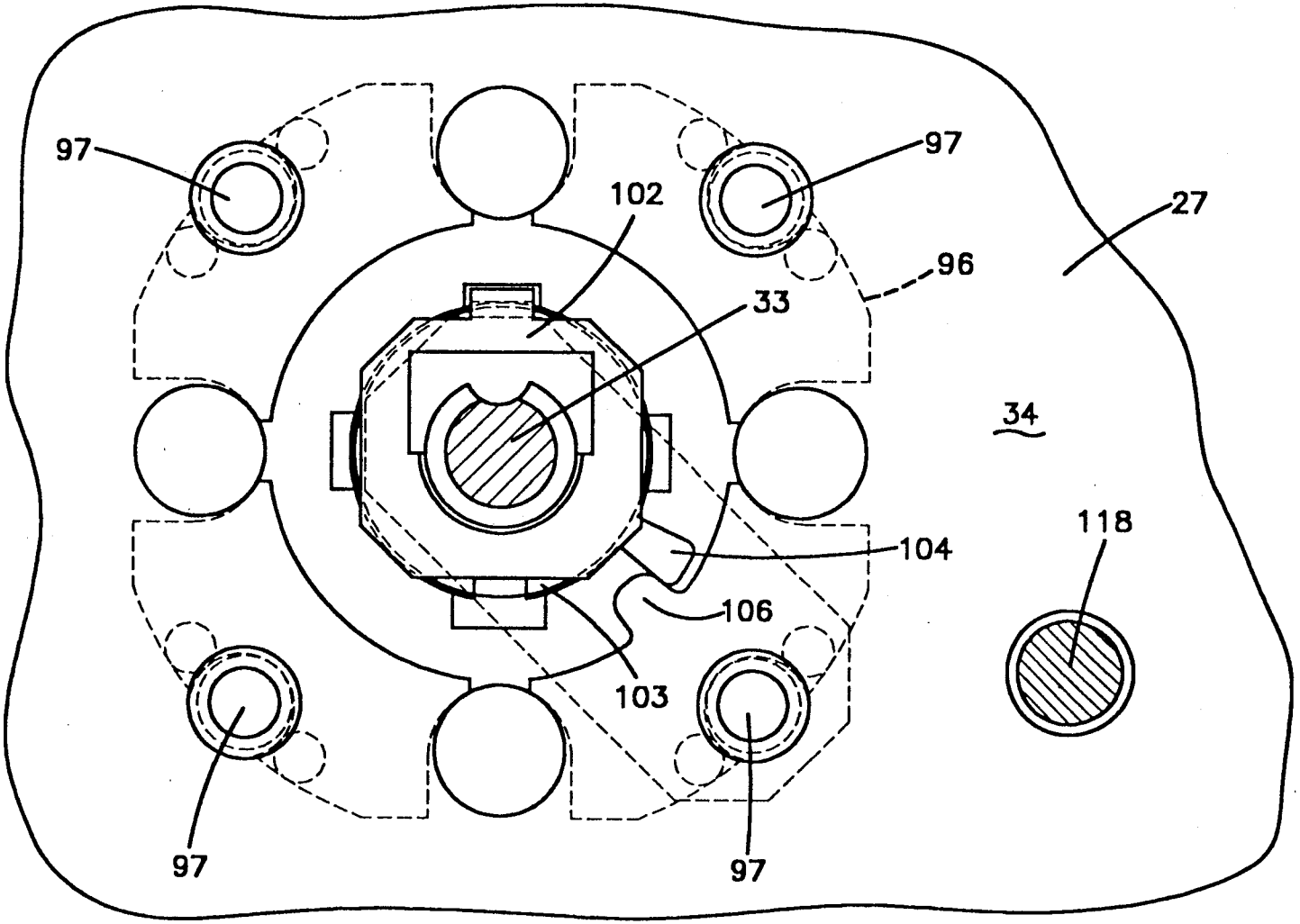
FIG. 8 is an enlarged fragmentary section taken along line 8—8 of FIG. 3.

Referring to FIG. 3, the bellows 38 provides an upper side wall 41 and a lower side wall 42, which flex toward and away from each other in response to changes in temperature sensed at the bulb 21. Mounted on the upper side wall is a mounting lug 43 which is internally threaded to receive the threaded stud 44*a* of a cam follower 44 (see FIG. 7). The cam follower 44 engages a face cam portion 46 of an adjusting cam 47 mounted on the control shaft 33. The engagement between the face cam 46 and the cam follower 44 causes upward or downward movement of the bellows 38 to adjust the operating temperature for BAKE and BROIL operations of the associated oven. Calibration of the BAKE/-BROIL range of operations is accomplished by threading the cam follower stud in or out of the mounting lug 43. To permit such calibration, the cam follower is provided with a driven gear 45*a* which meshes with a drive gear or calibration gear 45*b* journaled in the bellows support 48. The drive gear 45*b* is located laterally to one side of the cam 47 so that it can be accessed through an opening 49 in the upper body portion 27. The drive gear 45*b* is preferably provided with a slot (not illustrated) so that a screwdriver-type calibration tool can be inserted through the opening 49 to engage and turn the drive gear 45*b*. By rotating the drive gear 45*b*, the stud 44*a* of the cam follower 44 is threaded toward or away from the bellows 38. This functions to adjust the position of the upper side wall of the bellows with respect to the cam 47.

Mounted on the lower side wall 42 of the bellows 38 is an output lug 51. This output lug 51 moves up and down relative to the body as the lower side wall 42 moves toward and away from the upper side wall 41 in response to changes in volume of the liquid within the bellows/probe circuit. Since the position of the upper side wall 41 is determined by the setting of the cam 47 and the calibration of the cam follower 44, the position of the output lug is a function of the temperature sensed at the bulb 21.

Positioned below the output lug 51 is a Valverde spring 52. The Valverde spring 52 is supported on a pair of support posts 53 and 54 of a support member 56. Such spring provides an operating end 57 which moves with snap action back and forth when the output lug 51 engages and moves the engaged portion 58 back and forth.

Figure 4:
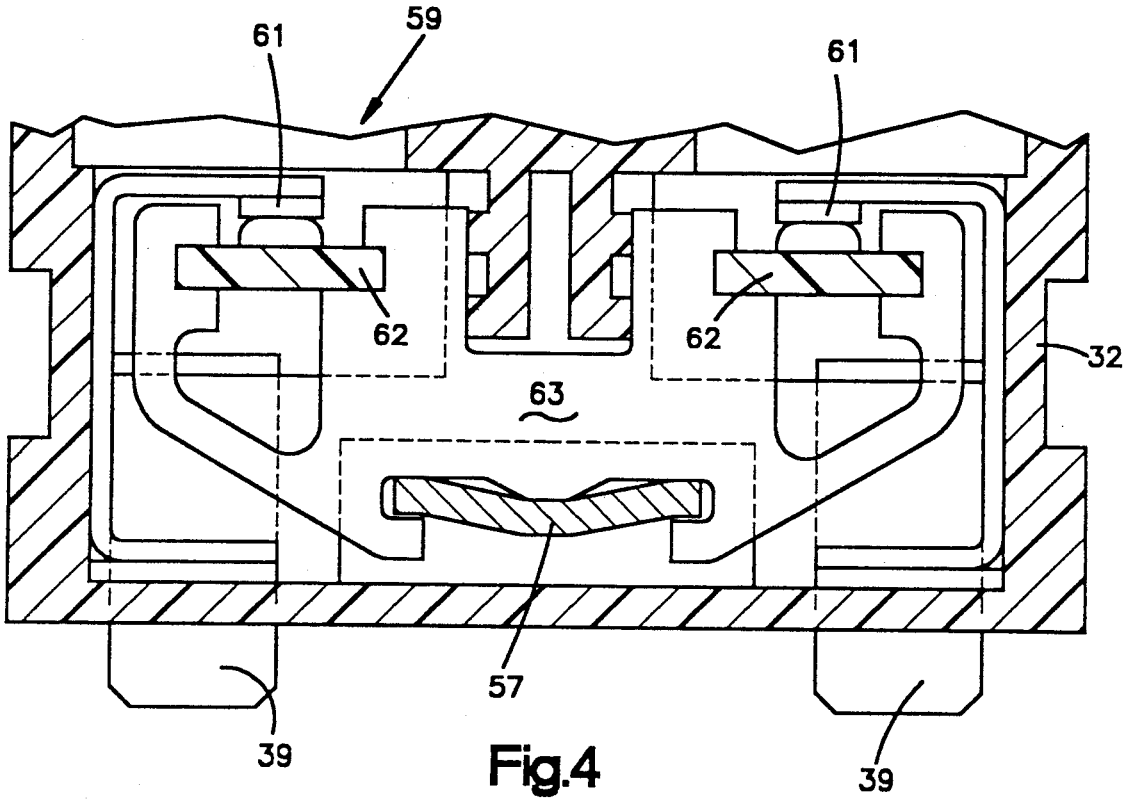
FIG. 4 is an enlarged, fragmentary section, taken generally along line 4—4 of FIG. 3.

The operating end 57 connects with a double-pole, single-throw switch 59 (illustrated in FIGS. 3 and 4) mounted in the switch case 32. As illustrated in FIG. 3, each pole provides a pair of contacts 61 which are connected by a shorting bar 62 when the switch is closed. The two shorting bars 62 are connected to the operating end 57 of the Valverde spring by an insulating connector 63, as best illustrated in FIG. 4. This double-pole, single-throw switch 59, which is operated with snap action and provides multiple contacts, is capable of connecting and disconnecting the relatively high current loads required by the two heaters 18 and 19, and constitutes the switch which modulates the operation of such heaters to maintain a desired temperature within the oven. The switch is cycled open and closed by the output lug 51 of the bellows 38 so as to maintain an oven temperatue corresponding to the temperature setting of the cam 47 during the BAKE and BROIL range. Also as discussed below, this switch functions to regulate the temperature of the oven during the cleaning cycle as well.

Figure 5:
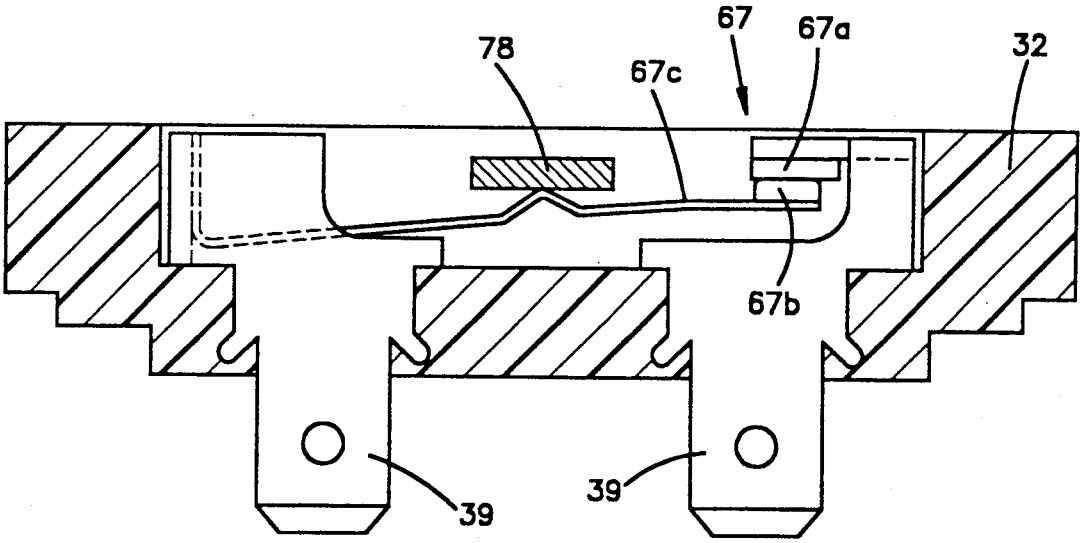
FIG. 5 is an enlarged fragmentary section taken along line 5—5 of FIG. 3.
Figure 11:
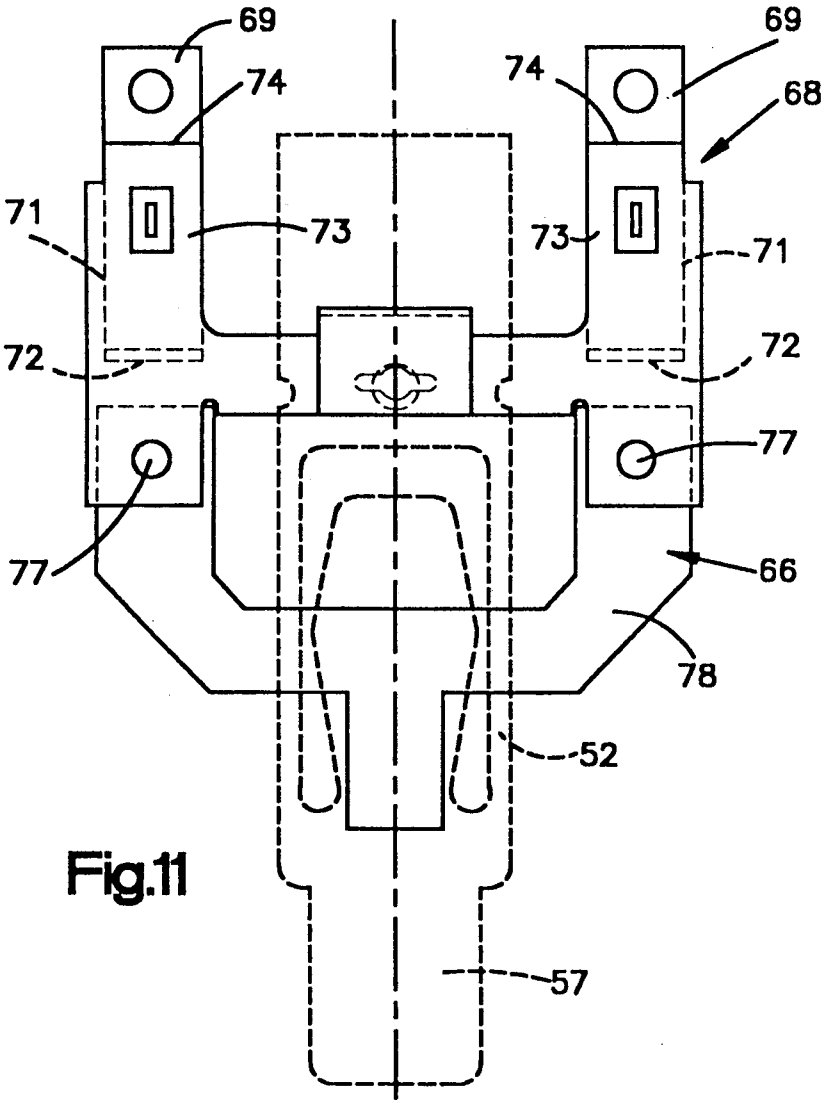
FIG. 11 is a plan view of the switch operator subassembly for the door lock switch.

Reference should now be made to FIGS. 3, 5, and 11. Positioned below the Valverde spring 52 is a second switch operator 66 which controls the operation of a door lock switch 67. Such door lock switch is interconnected with the control circuit of the range 10 to operate the door lock so as to prevent the oven door from being opened whenever the temperature of the oven is above a predetermined temperature, such as a temperature of 550° to 600° F. Such switch operates only during the cleaning cycle when the temperature of the oven is increased to sufficiently high temperatures (in the order of 800° to 850° F.) to eliminate any debris which is present in the oven. If the user could accidentally open the door to the oven at such elevated temperatures, a very hazardous condition would exist.

The switch operator 66 is also operated by the bellows 38. However, a structure is provided so that the setting of the cam 47 has substantially no effect on the operating temperature of the door lock switch. Further, the switch operator 66 of the door lock switch is provided with a separate calibration element so that it can be separately calibrated to ensure the desired operating temperature.

The switch operator 66 includes an S spring 68 having first legs 69 secured to the lower body portion. The S spring provides second legs 71 joined at one end to the first legs 69 by reverse bends 72, and at the other ends to third legs 73 by reverse bends 74. The reverse bends 72 and 74 provide a pivot-like connection between connected legs of the spring. The legs 73 provide stiffening flanges 76. Rivets 77 connect the thrid legs 73 to an insulating operator extension 78 which extends from the S spring per se to the door lock switch 67.

The calibration screw 79 carried by the third legs 73 extends up into engagement with the side of the engaged portion 58 of the Valverde spring opposite the output lug 51. The calibration screw 79 is threaded back and forth to calibrate the operating temperature of the door lock switch 67 at the desired predetermined door lock operating termperature.

FIG. 5 illustrates the structure of a normally closed-style door lock switch 67. Such switch has a fixed contact 67*a* and a movable contact 67*b* carried by a support arm 67*c*. The switch is a single-pole, single throw, normally closed switch which is opened on temperature increase at the door lock operating temperature by the extension 78 of the switch operator 66. In the illustrated embodiment, the switch is normally closed and is opened on temperature rise, which is the requirement for some types of door lock operators. If desired, however, a modified door lock switch 67 can be provided in which the switch is normally open and is closed on temperature rise. Further, if desired, snap-acting switches can be substituted. However, generally, a creep action switch of the type illustrated in FIG. 5 is preferred, since such switch does not have to handle high loads and does not have to operate through a multitude of cycles.

In order to render the door lock switch insensitive to the adjusted position of the cam 47, and in turn insensitive to the adjusted position of the bellows 38, a bellows link 81 connects at its upper end with the mounting lugs 43 at 82 and at its lower end connects to the second legs 71 at 83. This bellows link compensates for changes in the adjusted position of the mounting lugs 43 so that the operation of the door lock switch is responsive only to a sensed temperature and is not affected by the position of the cam. When, for example, the cam 47 is adjusted to move the mounting lug 43 downwardly, such motion is transmitted by the bellows link 81 to the second leg 71 of the S spring and results in corresponding downward movement of the reverse bend 74 and the adjacent end of the third leg 73.

The door switch operator 66 is proportioned so that the ratio of the distances from the reverse bend 74 to the connection 83 with respect to the distance between the connection 83 and reverse bend 72 is substantially equal to the ratio of the distances between the reverse bend 74 from the line of action of the calibration screw 79 to the distance from the line of action 79*a* of the calibration screw 79 to the point where the switch operator 76 engages the movable contact support of the door lock switch 67. When such spacing relationships are provided, the point of contact between the switch operator and such movable contact support at the location 84 remains substantially constant when the cam 47 is rotated to change the position of the bellows 68. Consequently, only the expansion of the bellows functions to operate the door lock switch 67, and such operation occurs at substantially a predetermined temperature determined by the position of the calibration screw 79 alone.

It should be understood that a mathematically perfect compensation is not necessarily provided, and that the temperature at which the door lock switch is operated will remain only substantially constant as the cam 47 is rotated from the OFF position to the CLEAN position (discussed in more detail below). In order to assure safe temperature unlock of the oven door, the arm ratio is adjusted so that the door lock set point is slightly higher with the shaft in the OFF position setting than in the CLEAN position setting.

By providing this automatic compensation for the operation of the door lock switch, a problem existing in some prior art oven controls is eliminated. In some such prior art controls, the door lock switch operating temperature followed the temperature settings of the control. In such instance, if after the cleaning operation had been completed and the oven had cooled down the user turned the control to the OFF position, the door lock remained locked and it was necessary to return the thermostat upscale toward the BROIl or CLEAN position before the door lock would open. This in the past resulted in confusion of some users and resulted in service calls which were unnecessary. With the present invention, such condition is avoided and the door lock is released automatically when the temperature of the oven cools down below the door lock operating temperature regardless of the adjusted position of the control.

Figure 6:
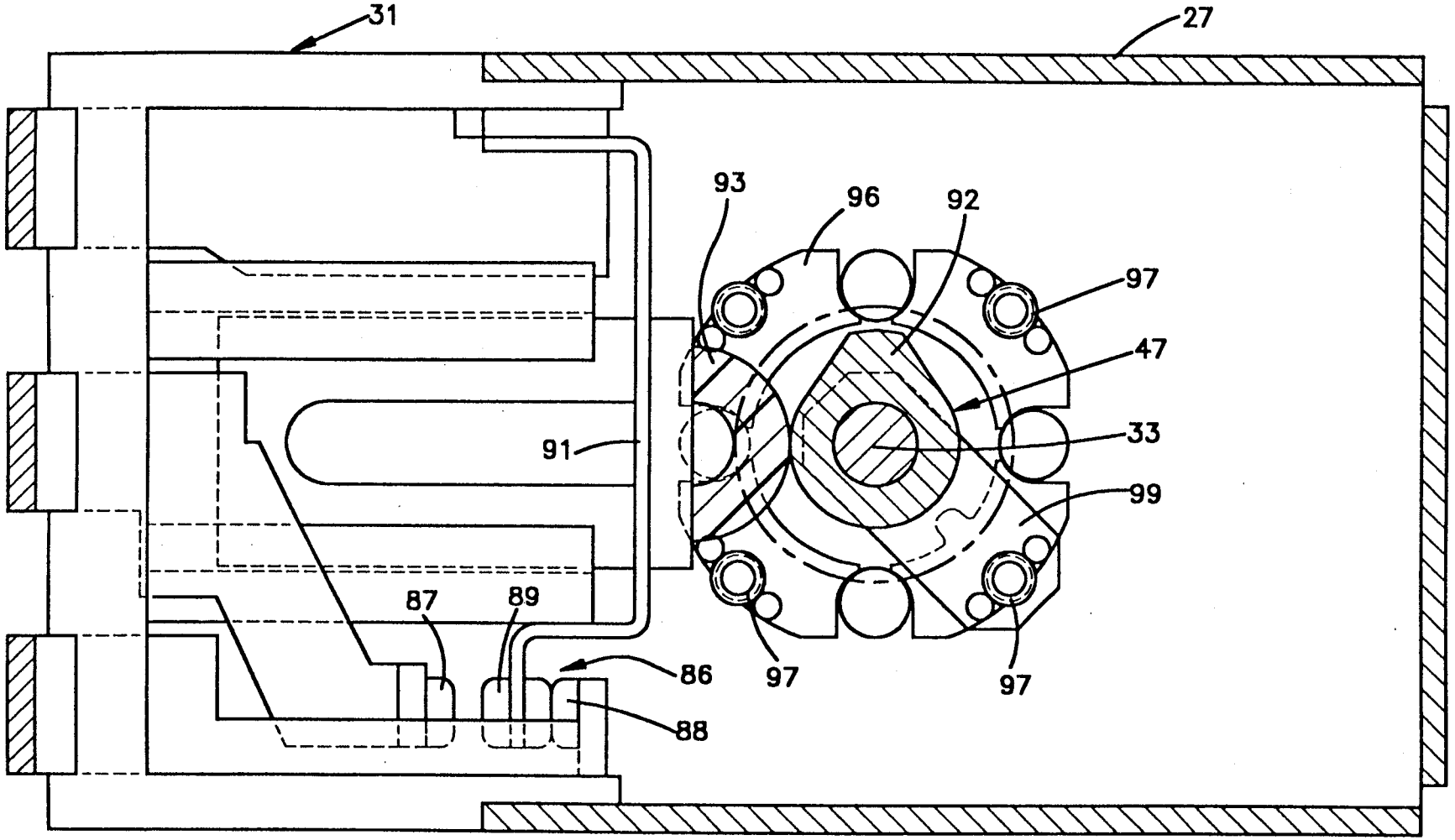
FIG. 6 is an enlarged staggered section taken along line 6—6 of FIG. 3.

In addition to the two switches 59 and 67, the control provides a selector switch 86, illustrated in FIG. 6. Such switch is a double-throw, single pole switch having fixed contacts 87 and 88 and movable contact means 89 carried by a movable contact support arm 91. This switch is operated by a side cam projection 92 formed on the cam 47 above the face cam 48. The projection 92 engages a switch operator 93 slidably mounted in the switch case 31 when the switch is in the OFF position or the CLEAN position, causing the movable contact 89 to close with the fixed contact 87. In the remaining positions of the cam, the switch contact 89 closes with the fixed contact 88. This selector switch 86 is normally connected to the range control circuit in a manner that prevents BAKE or BROIl operation when the main selector switch 16 is not in one or the other of such selected positions. Further, it prevents the operation of the range in a cleaning cycle unless the selector switch 16 as well as the control 11 are set in the proper position for cleaning operations.

In addition to the temperature sensing provided by the bulb 21 and resulting operation caused by the expansion or contraction of the bellows 38, ambient temperature compensation is provided. In many instances, the control 11 is mounted substantially adjacent to the oven or adjacent to the surface unit 13. Consequently, the temperature at the control may vary widely from normal room temperature and cause inaccuracies of regulation if ambient temperature compensation is not provided. This is partially due to the fact that the amount of liquid in the bellows, although very small, expands and contracts with the variations in ambient temperature.

In order to provide ambient temperature compensation, the shaft 33 and cam 47 are positioned against a bimetal compensating element 96. Reference should be made to FIGS. 7, 8, 12, and 13 for a clear understanding of the mounting of the shaft 33 and cam 47, as well as the ambient temperature compensation.

The bimetal compensator 96 is mounted on the underside of the upper body portion 27 by a plurality of rivets 97. Dimples or projections 98 are provided adjacent to the rivets 97 to establish a space therebetween to allow the central portion of the compensator to flex in an upward direction upon increasing ambient temperature. The bimetal compensator is mounted with the high expansion side upward so that increases in ambient temperature will cause the compensator to bow upward an amount which is a function of the ambient temperature.

a hardened bearing strip 99 is positioned between the cam 47 and the bimetal compensator to prevent wear of the bimetal compensator when the cam is rotated during adjustment of the oven temperature.

The shaft 33 is provided with a shoulder 101 which bears against a detent spring 102 and positions such spring with respect to the shaft 33. Positioned on the side of the detent spring 102 opposite the shoulder 101 is a stop ring 103 having a projection 104 engageable with an abutment projection 106 to limit the amount of rotation of the shaft 33 and the cam 47 between the two extreme limits of rotation thereof. Positioned on the side of the stop ring 103 opposite the shoulder 101 is a Belleville spring 107 which is placed in compression during the mounting of the cam 47.

The Belleville spring 107 engages the upper side of the bimetal compensator 96 at its periphery and the stop ring 103 adjacent to the shaft 33. Therefore, the shaft 33, and in turn the cam 47, are resiliently urged in the upward direction, maintaining contact between the bearing strip 99 and the adjacent surface of the cam regardless of the position assumed by the bimetal compensator. Consequently, the cam 47 automatically moves up and down in response to movement of the bimetal compensator created by changes in the ambient temperature of the switch.

Assembly is easily accomplished by pressing the shaft 33 down into the cam 47 and swaging the end at 108 when the Belleville washer is properly compressed.

The detent spring 102 has a lateral projection 111 extending through an opening in the Belleville spring 107 and into one of three selected openings 12 in the bimetal compensator. As the shaft and cam are rotated, the projection 111 snaps in and out of the associated openings 112 to provide a detent operation in three positions of the cam. The openings 112 are positioned so that the projection 111 extends into one of the openings in the OFF position, the CLEAN position, and the BROIL position. Therefore, the user is aware that the control is set in one of these three positions by the detents.

With this ambient temperature compensation, control regulation is substantially unaffected by changes in the ambient temperature of the control so the control can be installed close to the oven or surface units without losing the accuracy of operation.

Figure 9:
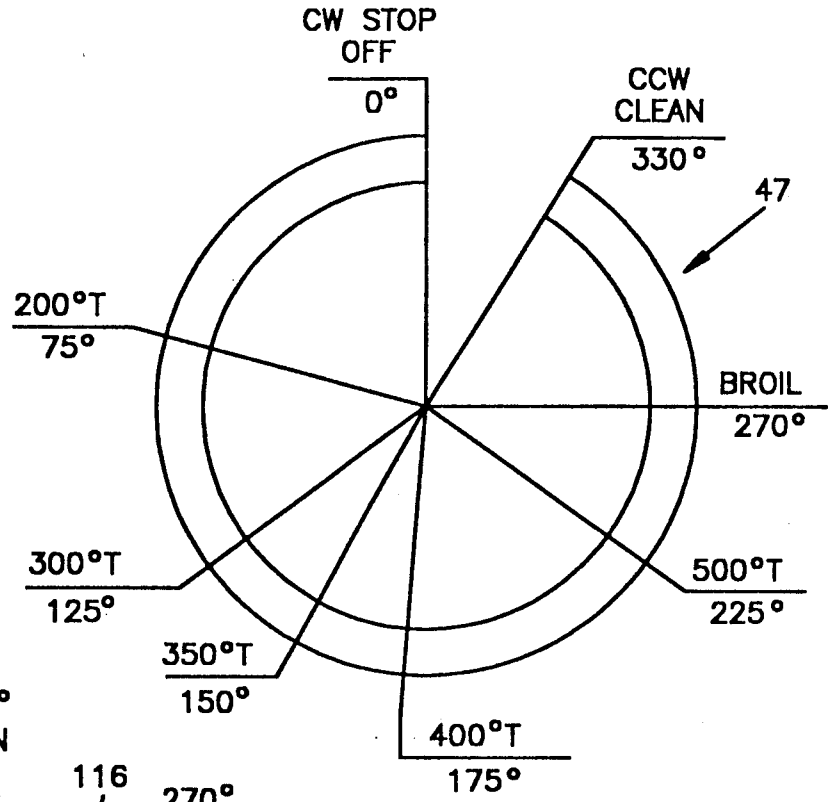
FIG. 9 schematically illustrates the temperature-versus-control shaft rotation relationship of the control.
Figure 10:
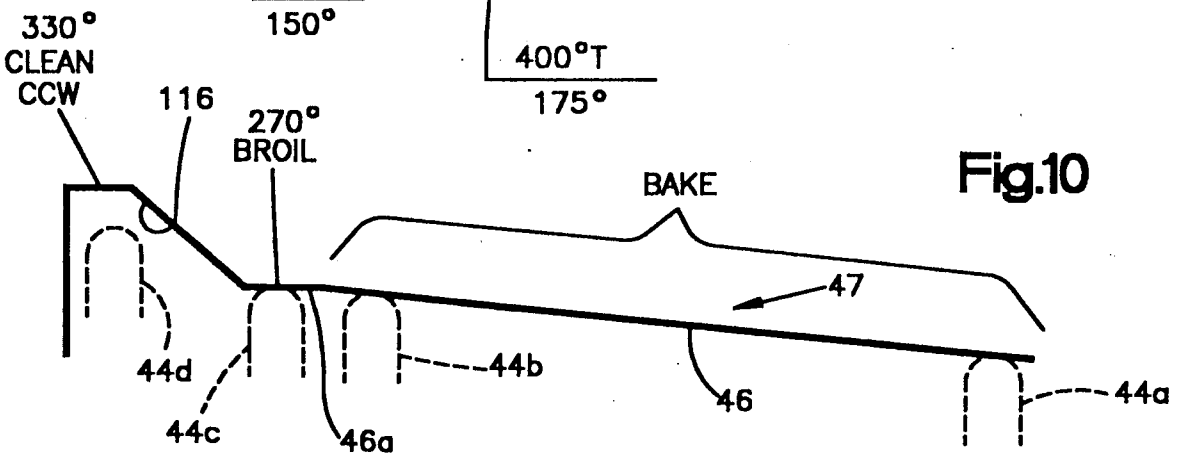
FIG. 10 is a rollout view of the cam surface of the control.
Figure 12:
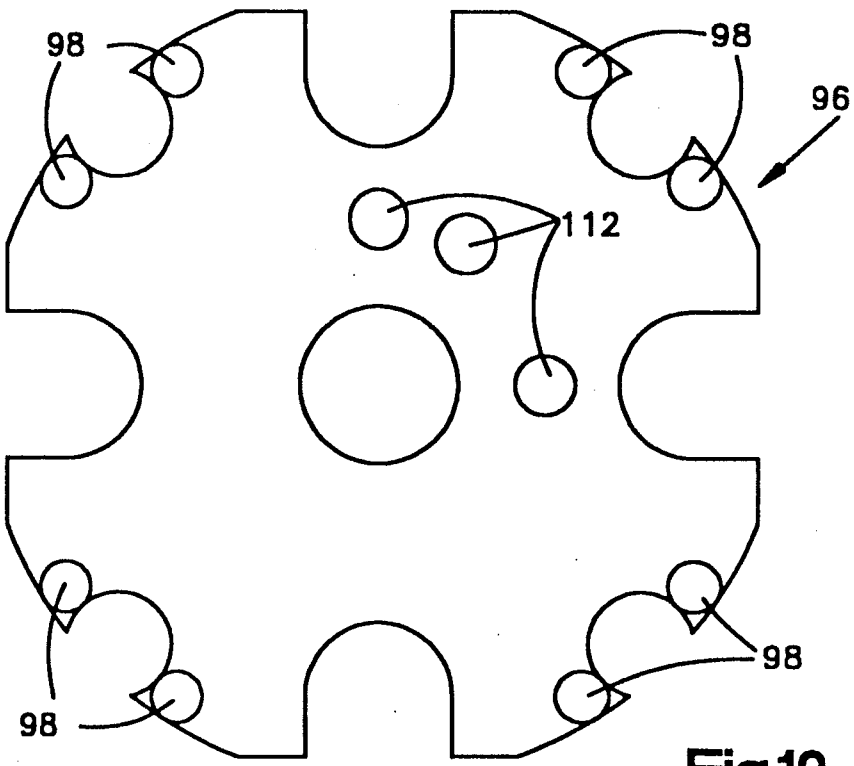
FIG. 12 is a plan view of the bimetal ambient temperature compensator.
Figure 13:
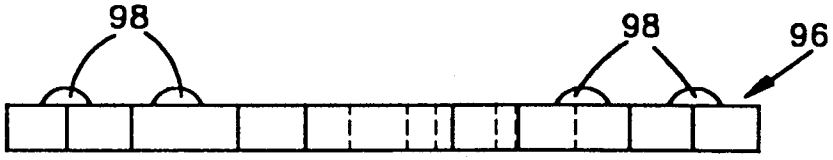
FIG. 13 is a side elevation of the bimetal compensator of FIG. 12.

The face cam has a profile, best illustrated in FIG. 10, which is a rollout view of the face cam profile. When the switch is in the OFF position, the cam follower is in the position 44*a*, indicated in phantom in FIG. 10. As the cam is rotated from the OFF position through the BAKE range, indicated by brackets, the operating temperature of the oven is increased in a linear manner until the cam follower 44 reaches the position 44*b*. As best illustrated in FIG. 9, the cam 47 is rotated through almost 270 degrees in the BAKE range. The cam follower assumes a position against a horizontal portion 46*a* indicated at 44*c* when the control is set in the BROIL position. By providing a flat 46*b* at the BROIL position of 270 degrees of rotation, consistent control temperatures during BROIL are achieved and variations created by tolerances and the like are accommodated. One of the detents operates in this position.

The cam is provided with a recess 116 at the 330 -degree position, which is sized so that the cam follower in the position at 44*d* does not contact the wall of the recess. In such position, the upward movement of the mounting lug 43 is limited not by the cam but by the bellows support 48 which engages a shoulder 117 on the mounting lug 43. Therefore, the CLEAN temperature is not regulated by the cam 47 but, instead, is regulated by the position of the bellows support 48. Calibration of the CLEAN temperature regulation is provided by a screw 118 which extends through the upper metal body portion 27 and is threaded into the bellows support 48. The bellows support 48 is shaped and sized so that, prior to calibration, the bellows will be held in a lower than desired position, which would cause lower than desired CLEAN temperatures. During calibration, the screw 118 is then threaded into the support 48 to deflect the support upwardly and bring the CLEAN temperature into calibration.

With the present invention, the power switch 59 is operated in the BAKE and BROIL modes of operation at temperatures which are calibrated by rotation of the cam follower 44 by the drive gear 45*b*. This calibration, however, only affects the BAKE and BROIL temperature regulations, which are subsequently controlled by the setting of the cam 47.

A completely separate calibration of the operating temperature during the CLEAN cycle is provided by the screw 118, which deflects the bellows support 48 and independently calibrates and controls the CLEAN temperature operation.

Still further, a completely independent calibration of the temperature of operation of the door lock switch 67 is provided by the calibration screw 79 and the control is structured so that the temperature of operation of such door lock switch is substantially independent of the position of the cam 47. Therefore, with this invention, three separate calibrations are provided for the operation of switches by a single temperature sensing bellows 38. The mounting bracket 34a provides the mounting surface 34b spaced from the upper surface 34 of the upper metal body portion 27 so that the calibration of the control is not altered by the mounting of the control.

With this invention, a compact control is provided which can be used in conjunction with sbstantially any type of self-cleaning oven. Because the principal body structure is provided by two sheet metal stampings 27 and 28, a strong, compact unit results. The three switches involved are mounted in plastic switch cases secured to the metal body portions 27 and 28.

Although the preferred embodiments of this invention have been shown and described, it should be understood that various modifications and rearrangements of the parts may be resorted to without departing from the scope of the invention as disclosed and claimed herein.

What is claimed is:

1. An oven control for self-cleaning ovens comprising a body, a hydraulic sensing unit having a wafer-like bellows mounted in said body, said bellows providing first and second opposed side walls movable apart in response to increased sensed temperature and toward each other in response to decreases in sensed temperature, an elongated control shaft mounted in said body for rotation about its axis, cam means mounted on said shaft operating to adjustably position said first wall of said bellows relative to said body, first switch connected for operation by said second side wall for controlling the temperature of an associated oven, said cam means operating to move said first side wall relative to said body to adjust the temperature of operation of said first switch within a range of temperatures, and a second switch operated by said second side wall in response to a substantially fixed predetermined temperature regardless of the position of said cam means.

2. An oven control as set forth in claim 1, wherein a second switch actuator is provided to operate said second switch in response to movement of said second side wall of said bellows.

3. An oven control as set forth in claim 2, wherein a connector connects said first side wall and said second switch actuator, rendering said second switch insensitive to the position of said first side wall of said bellows.

4. An oven control as set forth in claim 3, wherein said second switch actuator includes a spring support having a plurality of legs connected by reverse bends for pivot-like relative movement, and said connector connects with one of said legs.

5. An oven control as set forth in claim 1, wherein said second switch provides a switch actuator including a spring assembly providing a pair of legs connected at one end for pivot-like movement, one of said legs being mounted at its other end on said body for pivot-like movement, the other end of said other leg operating said second switch, a first connection between said first side wall and said one leg moving said one end of said leg in response to movement of said first side wall, and a second connection connecting said other leg and said second side wall and operating said second switch in response to movement of said second side wall.

6. An oven control as set forth in claim 1, wherein said second switch is connected to said bellows for operation of said second switch substantially when said first and second side walls are spaced apart a predetermined distance.

7. An oven control for self-cleaning ovens comprising a body, a first switch on said body for controlling oven heaters and controlling the oven temperature a second switch on said body for operating an oven door lock during self-cleaning, and an adjustable temperature sensor providing an output surface movable in response to changes in oven temperature, said output surface being connected to operate said first switch in response to movement of said output surface to a predetermined position, adjustment of said sensor providing adjustment of the temperature of operation of said first switch, said output surface being connected to operate said second switch in response to a substantially constant predetermined temperature independent of the adjustment of said sensor.

8. An oven control as set forth in claim 7, wherein first calibration means are connected to said temperature sensor for calibrating the operation of said first switch with respect to the adjustment of said temperature sensor, and separate second calibration means are connected to said temperature sensor for calibrating said predetermined temperature.

9. An oven control for self-cleaning ovens comprising a body, a sensing unit providing opposed first and second sides movable apart in response to increasing temperature and towards each other in response to decreasing temperature, a control shaft journaled on said body for rotation about an axis, a cam mounted on said shaft operating to adjust the position of said first side relative to said body, switch means on said body operated in response to movement of said second side, and bimetal ambient temperature compensating means adjusting the position of said cam relative to said body in response to changes in ambient temperature so that the operation of said switch means is substantially unaffected by changes in ambient temperature.

10. An oven control as set forth in claim 9, wherein spring means resiliently bias said cam toward said temperature compensating means to ensure positioning of said cam by said temperature compensating means.

11. An oven control as set forth in claim 10, wherein a hardened bearing material is positioned between said compensating means and said cam preventing said cam from producing wear of said compensating means.

12. An oven control as set forth in claim 11, wherein said spring means is a Belleville spring.

13. An oven control as set forth in claim 9, wherein a stop on said shaft is engageable with an abutment on said body to limit rotation of said shaft between predetermined first and second limits of rotation.

14. An oven control as set forth in claim 13, wherein said control is "OFF" in said first limit of rotation and is in a "CLEAN" mode in said second limit of rotation.

15. An oven control as set forth in claim 13, wherein a detent member on said shaft projects into detent openings in a plurality of positions to provide user-awareness that the control is in one of said plurality of positions.

16. An oven control as set forth in claim 15, wherein said detent openings are formed in said bimetal compensator means.

17. An oven control as set forth in claim 9, wherein said cam provides a face cam, said sensing unit providing a cam follower engaging said face cam and cooperating to adjustably position said first side of said sensing unit in response to rotation of said cam.

18. An oven control as set forth in claim 17, wherein said face cam provides a bake temperature adjusting portion extending along said face cam through an angle approaching 270 degrees.

19. An oven control as set forth in claim 18, wherein said face cam provides a flat "BROIL" portion engaged by said cam follower when said control is set for a BROIL operation.

20. An oven control as set forth in claim 19, wherein a detent is provided indicating said control is set for a BROIL operation.

21. An oven control as set forth in claim 18, wherein said cam provides a recess proportioned to clear said cam follower when said control is set for a "SELF-CLEANING" operation.

22. An oven control as set forth in claim 21, wherein a support is provided for said sensing unit which controls the position of said sensing unit and a regulated temperature in "SELF-CLEANING" operations.

23. An oven control as set forth in claim 22 wherein calibration means are connected to position said support and calibrate the SELF-CLANING temperature of said control.

24. An oven control as set forth in claim 17, wherein said cam also provides a lateral cam projection operable to operate a selector switch.

25. An oven control for self-cleaning ovens comprising a body, a first switch on said body for controlling heating means in an associated oven, a second switch for controlling an oven door lock, a sensor connected to said first switch for adjustably controlling the temperature in said associated oven sensed by said sensor within a BAKE temperature range and controlling the temperature in said associated oven at a SELF-CLEANING temperature, said sensor being connected to operate said second switch at an intermediate temperature above said BAKE temperature range and below said SELF-CLEANING temperature for controlling an oven door lock, and separate first, second and third independent calibration means, said first calibration means being connected to independently calibrate the BAKE temperature range, said second calibration means being connected to independently calibrate said self-cleaning temperature, and said third calibration means being connected to independently calibrate said intermediate temperature.

26. An oven control as set forth in claim 25, wherein a cam is mounted on said body and is connected to said sensor to adjust the operating temperature of said first switch in said BAKE temperature range.

27. An oven control as set forth in claim 26, wherein said cam also controls the temperature of said associated oven during BROIL operations.

28. An oven control as set forth in claim 27, wherein said sensor controls the temperature of said associated oven during SELF-CLANING operation independent of said cam.

29. An oven control as set forth in claim 28, wherein said sensor controls said intermediate temperature independent of the adjustment of said cam.

* * * * *